US005389155A

United States Patent [19]

Lima

[11] Patent Number: 5,389,155

[45] Date of Patent: Feb. 14, 1995

[54] LIQUID REMOVAL PROCESS IN PIPELINES THROUGH A MOVING PISTON

[75] Inventor: Paulo César Lima, Rio de Janeiro, Brazil

[73] Assignee: Petroleo Brisileiro S.A. - Petrobras, Rio de Janeiro, Brazil

[21] Appl. No.: 99,517

[22] Filed: Jul. 30, 1993

[30] Foreign Application Priority Data

Jul. 31, 1992 [BR] Brazil ..... 9202987
Jul. 5, 1993 [BR] Brazil ..... 9202987

[51] Int. Cl.[6] ..... B08B 9/00; B08B 9/04; B08B 902

[52] U.S. Cl. ..... 134/8; 134/22.11; 134/22.1

[58] Field of Search ..... 134/8, 22.11, 22.1

[56] References Cited

U.S. PATENT DOCUMENTS 2,906,650 9/1959 Wheaton ..... 134/8
5,032,185 7/1991 Knapp ..... 134/22.11

FOREIGN PATENT DOCUMENTS 1270378 12/1972 United Kingdom ..... 134/8

*Primary Examiner*—Richard O. Dean
*Assistant Examiner*—Zeinab El-Arini
*Attorney, Agent, or Firm*—Sughrue, Mion, Zinn, Macpeak & Seas

[57] ABSTRACT

A process for use in gas pipelines, where the condensate liquid is withdrawn by passing a cylinder made out of a spongy polymeric material through the pipeline, includes propelling the cylinder by a small pressure difference between the trailing part of the cylinder and the front part of the cylinder, so that the displacement of the cylinder along the interior surfaces of the pipeline pushes the above mentioned condensate. The piston is made out of a spongy material, preferably flexible spongy polyurethane with a density lower than 40 kg per cubic meter so that the piston only suffers a maximum dimensional loss of 0.50% after traveling pipelines with a total length of more than 1000 km.

5 Claims, 2 Drawing Sheets

LIQUID REMOVAL PROCESS IN PIPELINES THROUGH A MOVING PISTON

FIELD OF THE INVENTION

The present invention concerns an efficient process for removal of condensate or deposited liquids in pipelines through the use of a certain type of moving piston.

PRIOR ART

The retention of liquids in pipelines used mainly for the conduction of gases impairs the transport process and causes largely inadmissible contamination.

This retention can be verified under the form of liquid holdups, occurring in pipeline segments for a variety or reasons, and whose presence, if unremoved, will reflect negatively in the flow control of the transported gases through alteration of the flow parameters, as well as through alteration in the material balance of the flow product components, an aggravating circumstance if this composition represents an important variable in a later processing phase. The transport of gases from petroleum production sites, such as oil wells, or even in intermediate stages of product fractionation, represents such a case.

Another critical aspect in this case concerns the water removal from a gas pipeline so as to increase the gas transport efficiency and avoid contamination of the transported product, principally where water is used for certain specific reasons before the transport operation.

Until now, pipeline cleaning (including liquid removal) has been carried out in a precarious way by use of various forms of pigs, most of them spherical and made out of a polyurethane elastomer (with good dimensional stability and a reduced capacity for elastic deformation), mainly for condensate removal in gas pipelines, As the specialists in the field can easily envision, these pigs are introduced in the pipeline through a special opening named "inlet opening" or "opening for introduction", and from this point onwards forced through the pipeline by high fluid pressure difference, so as to entrain all foreign materials at high speed until the final removal of materials and pigs from the pipeline through an "outlet opening" or "reception opening".

One of the problems experienced with the existing pigs for pipeline cleaning refers to its insufficient elasticity (or deformation capacity). This lack of elasticity causes high forces, incident perpendicularly to the interior surfaces of the pipe. This perpendicular force causes high friction and wear and can lead to the jamming of this kind of pigs, specially when these pigs do not occupy the whole cross section of the pipeline.

Pigs made out of more flexible kind of foams, such as low density polyurethane, constitute a way out of this problem, as illustrated by U.S. Pat. No. 5,032,185, involving the sequential introduction of low density polyurethane pigs, herein defined as a value lower than 64 kg/m/$^3$, for the cleaning of paraffin deposits in pipelines.

In all solid matter cleaning processes using pigs, be it the process mentioned in said U.S. Patent or any other one, the material density cannot be specified much below this limit without endangering the removal efficiency.

That is the reason why all processes for impurity removal through low density foam pigs only use these devices for the entrainment of solid residue in liquid over a short distance.

Condensate removal procedures in gas pipelines, on the other hand, use inflatable polyurethane spheres, recognized worldwide as the most economic way for doing this kind of work. Unfortunately, this kind of device cannot be used in long pipelines or in ones with significant diameter changes and without intermediate inlet openings, such as the environments found in hydrocarbon production sites located in great water depths at the ocean floor. Under these circumstances, the chances of damaging the spheres, or even their jamming, represent too big a risk for their practicable use. Another inconvenience in the use of this kind of spheres, due to its peculiar form, is the reduced sealing area, much less than the one produced by a cylindrical body. The necessity to run the spheres several times through the pipeline can be seen as a further inconvenient, causing additional operating costs for their return transport to the inlet opening.

Summary of the invention

The present invention refers to a liquid removal process in pipelines with the use of a device to be described further on and, for all practical reasons, named "piston" in view of the similarity between the device and the reciprocating piston-cylinder mechanism of a positive-displacement pump. Although the process is of a generic nature, it will be presented for application in long pipelines and specially, for condensate removal in gas conducting pipelines originating in oil wells or in far-off processing sites, where the condensate formation, unavoidable for several reasons, is considered a serious problem, as already mentioned.

The most important feature of the present invention refers to the fact that the circulating device for liquid removal, in our case the above mentioned "piston", has a predominantly cylindrical form, as can be seen in FIGS. 1, 2 and 3, annexed, and is made out of a very light kind of polyurethane (less than 40 kg/m$^3$), without need for any sort of protective resin or synthetic rubber coating, Ensuring an extreme degree of compressibility, decisive for its performance.

Another remarkable feature of this invention refers to the fact that the outside diameter of the piston can be much bigger than the inside diameter of the pipeline.

BRIEF DESCRIPTION OF THE DRAWINGS

The figures annexed are included for illustration of the important features of the piston, essential for the execution of the present process.

DETAILED DESCRIPTION OF THE INVENTION

Figure 1:
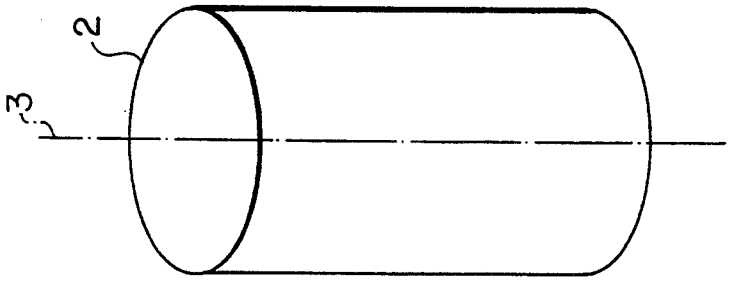
FIG. 1 shows a perspective projection of a cylindrically shaped piston.

FIG. 1 shows piston 1, of cylindrical shape and made out of very low density polyurethane foam (maximum of 40 kg/m$^3$). The experience revealed that this kind of piston performed well as a liquid propeller, exception made for the wear supported by the front edges 2, even when the longitudinal axis 3 of the piston remains parallel to the longitudinal axis of the pipeline, with the detachment of small particles caused by attrition with irregularities on the interior surfaces of the pipeline and by the flow distribution in front of the piston.

Figure 2:
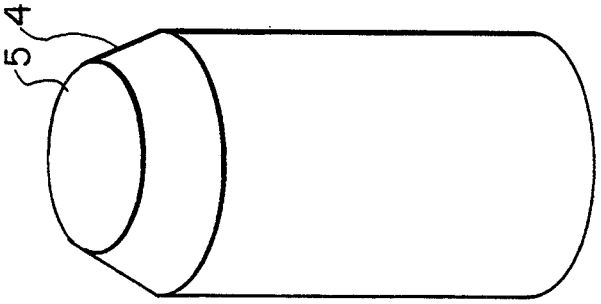
FIG. 2 shows a perspective projection of a cylindrically shaped piston with a bevel edged top part, giving it the aspect of the frustum of a cone.

The model shown in FIG. 2 was conceived so as to prevent the above mentioned inconveniences and features the frontal part 5 shaped as the frustum of a cone 4, without the above mentioned front edges, minimizing the destruction of the front edges and facilitating the introduction of the piston, specially when the piston radius is much bigger than the pipeline inside diameter.

Figure 3:
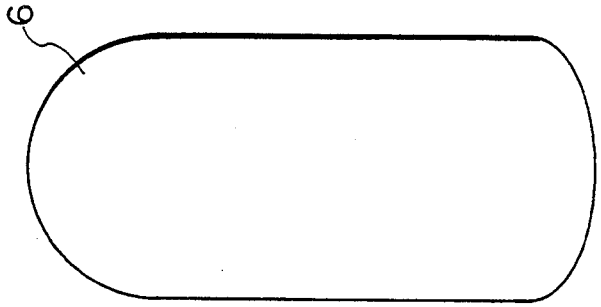
FIG. 3 shows a piston version in perspective, with a hemispheric or slightly parabolic finishing of the piston head.

For the same motives and resulting in a more suitable execution, FIG. 3 shows a piston with a rounded front part 6. Although this model does not represent a major improvement (in operation terms and during normal usage) when compared with the model in FIG. 2, its main advantage resides in a greater flexibility of piston movement when traveling in pipelines with diameter restrictions.

An important feature of the present process, with no counterpart in the traditional processes, refers to the possibility of introducing a piston through any kind of inlet opening, even much smaller than the piston dimensions, in view of the extreme compressibility of the very low density polyurethane foam, less than 40 kg/m$^3$ and preferably in the range between 17 and 33 kg/m$^3$.

As can be seen in FIGS. 1 to 4, the basic shape of the pistons is a cylinder, with the top part formed as the frustum of a cone or rounded off. The examination of these figures reveals a certain proportionality between total length and diameter of each piston. It is quite clear that the represented forms can be maintained if the length of the piston is more or less double its diameter (independent of the shape of the top part of the piston). In practice, this proportion can vary between more or less 1.5:1 and 2:1. Altogether, short pistons (with a height equal or less than its diameter) should be shunned so as to avoid overturning of the piston (spinning of the piston) when being propelled inside the pipeline. Very long pistons are not very effective either, subject to deformations that roughly could be classified as buckling; in other words, the gas and liquid phases pass between the interior pipe surfaces and the external surfaces of the piston, deforming the piston shape and interfering in its movement.

The present invention shows two big advantages in terms of process:

a) first of all, a dramatic price reduction of the piston used in the present process;

b) and second, the fact that the piston can easily be passed through diameter reductions in the pipeline renders this a very efficient process.

In fact, the former pipeline cleaning processes, adapted for liquid removal, use expensive pigs, made out of an expensive raw material, polyurethane elastomer, and resin or synthetic rubber coated against wear and gas permeation. In our case, the price of a polyurethane foam piston without any kind of coating is 150 times less expensive than its equivalent made out of a polyurethane elastomer. At this price level, pistons can be frequently changed before heavy wear sets in; it becomes even possible to consider the pistons as one-way products, making the operational procedure for pipeline cleaning much simpler. A comparison between the new method and the traditional systems was undertaken where the traditional devices could be used. The results obtained appoint to a probable change in procedure for condensate removal in gas pipe lines with the substitution of the traditional spheres by foam devices.

Figure 4:
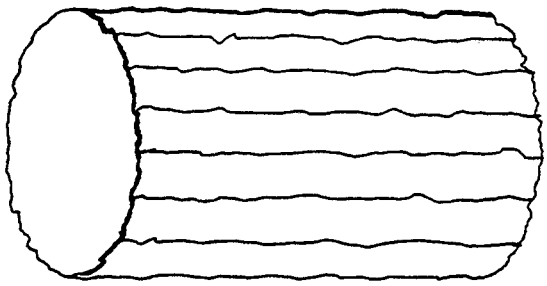
FIG. 4 shows a crudely formed piston, having however a satisfactory performance.

An implementation of this kind is shown schematically in FIG. 4. A piston was manufactured without any finishing, by simply cutting a cylinder (in this case, a rather rough prism) with a well honed cutting tool out of a polyurethane foam block of commercial grade. The repeated passing through great lengths of pipeline showed a surprisingly low wear rate and a highly satisfactory dimensional stability of the piston. At each passage through the pipeline, a minimum liquid removal efficiency of 90% was obtained with a maximum piston diameter loss of 0.50%.

Operational tests done with very low density polyurethane foam pistons showed surprisingly good performance results, compared to what was expected and to what was held to be true in prior art.

First of all, it was expected that the very low density polyurethane foam pistons without any kind of impervious resin coating, would not present a satisfactory abrasion resistance in any sort of operation. This expectation was fueled by the known fact that a flexible polyurethane piston, made out of 60 kg/m$^3$ material of excellent quality, did not present minimum working conditions after going through 3 km of pipeline.

The passage through a gas pipeline of 208 km length and 40.64 cm inside diameter, of a piston manufactured in accordance with the present invention, revealed the following results as to wear:

nominal diameter of the piston: 45.78 cm average real diameter of the piston: 45.46 cm final diameter of the piston after one passage through the pipeline: 44.95 cm In view of these results, it is reasonable to expect at least 10 passages through the test pipeline without notable wear of the piston. It should be remembered that a traditional pig made out of a polyurethane elastomer does not withstand two passages through a pipeline of the same length.

The present process exposed another misconception of prior art, namely, the necessity of an impervious coating by resin or synthetic rubber of the front part of the moving body (in our case, the piston, or the pig in prior art), so as to avoid gas passage through the pores of the material at high pressures, held to be very damaging. The piston of the present invention does not need any coating of its trailing part to ensure a satisfactory performance in propelling liquid through a pipeline.

Another advantage of this process resides in the fact that only a small pressure difference is enough to propel the piston along the interior surfaces of the pipeline, even when significant diameter changes occur for operational reasons. Being like that, the piston is propelled along the chosen pipeline segment by establishing a small pressure difference between its trailing part, the thrust side, and its front part, conceived for liquid displacement in the pipeline. The examples included for illustration of this description shown a wide variation in the proportion between the pipeline diameter and the piston radius, contrary to common belief held by those not knowledgeable about the real behavior of the material used.

A third advantage of the invention refers to a surprisingly good operating capacity in sections of pipeline with a total length of hundreds of kilometers, or even thousand kilometers, without loss of performance and needing only one inlet opening, doing away with intermediate collectors and introduction openings.

On the other hand, it should not be forgotten that the attrition caused by a rigid polyurethane elastomer pig, in accordance with prior art, is much higher than the attrition caused by the mentioned piston. The polyurethane elastomer pig has a limited flexibility and is introduced in the pipeline, inflated up to a diameter only slightly bigger than the inside diameter of the pipeline (a difference that amounts to a few millimeters), and as such, subject to jamming on passing an obstruction like a surface irregularity of the interior wall of the pipeline. In the case of a less elastic pig, however, the flow pressure of the propelling gas is kept high so as to speed on the pig, lessening the chances of jamming but increasing the chances of it being lacerated at certain stretches of the pipeline with restricted passage, such as low-radius curves misaligned flanges and localized bumps or diameter reductions, etc. The lion's share of pig losses occurs this way in gas pipelines.

The following examples leave no doubt about the relatively small piston wear rates observed under rather severe operating conditions, contrary to what could be expected from such a light and flexible material.

EXAMPLE 1

A piston with a 17.78 cm diameter was introduced into a 15.24 cm diameter pipeline with an extension of 72 km. The pipeline was used for conducting 340.000 $Nm^3$ of gas per day under a pressure of 56.24 $kg/cm^2$. The piston withdrew the condensate of the pipeline and arrived in due time at the outlet opening. The final diameter of the piston after its removal from the pipeline was 15.75 cm.

EXAMPLE 2

Under the same operating conditions as in example 1, a piston with a 20.32 cm diameter was introduced and removed with a final diameter of 17.53 cm.

EXAMPLE 3

Another dry test was done to evaluate the wear rate under severe attrition. A piston was introduced in a dry pipeline and propelled with a velocity of 21 m/s along 6 km of pipeline. The evaluation was done in terms of mass loss.

initial mass=82.91 g
final mass=71.80 g
ratio between the evaluated masses: 86%
relative mass loss=1.89 g/km Another important performance evaluation concerns the liquid removal capacity.

EXAMPLE 4

Specific water volumes, each representing a certain percentage of the total available volume, were deposited in a pilot pipeline. The total volume of water withdrawn was measured after the passage of a piston with a bevel edged front side, (FIG. 2). The results are summarized in Table I.

TABLE i

| Specific water (liters) | Volume withdrawn (liters) | $H_L$ % | Efficiency % |
|---|---|---|---|
| 400 | 390 | 91 | 97.5 |
| 206 | 200 | 47 | 97.1 |
| 100 | 94 | 23 | 94.0 |
| 40 | 37 | 9 | 91.3 |

$H_L$ is the liquid volume ratio in the pipeline

Figure 5:
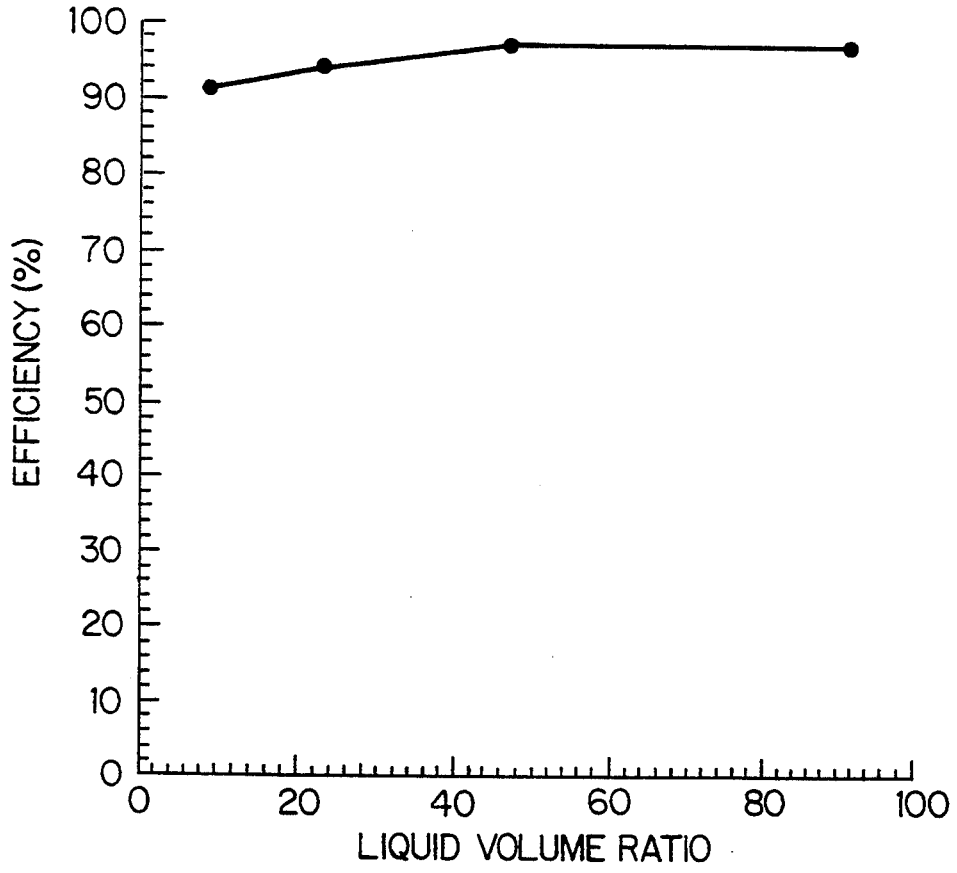
FIG. 5 shows a graphic with the liquid removal efficiency as a function of the volumetric fraction of liquid in the pipeline.

The graph in FIG. 5 shows a loss in efficiency associated with lower ratios of liquid volume in the pipeline. Even so, the efficiency is still over 90% for low values of $H_L$.

EXAMPLE 5

Operational Test of the Present Process with the Passage of the Piston Through Restricted Sections of a Pipeline.

This test illustrates the main qualities already mentioned of the process: the effective removal of liquid from a pipeline with the use of a piston of high compressibility, featuring a satisfactory performance in restricted passages (sometimes very restricted) and without losing its removal efficiency in the presence of a small pressure difference.

A piston with a diameter slightly bigger than 15.24 cm (as evidenced by the easy introduction of the piston into the inlet opening without notable deformation) passes through a diameter reduction from 15.24 cm to 10.16 cm before starting its course along a pilot pipeline, with a total extension of 48 m. During its trajectory, the piston passes several diameter reductions and a cycle of four small radius 90° bends. In function of the specific reduction, the necessary pressure difference was measured.

The results are summarized in Table II.

TABLE II

| Reduction | $A_T/A_E$ | $R_T/R_{EGE}$ | P ($kg/cm^2$) |
|---|---|---|---|
| from 10.16 cm to 7.62 cm | 0.234 | 0.484 | 0.84 |
| from 10.16 cm to 5.08 cm | 0.105 | 0.324 | 6.53 |

where,
$A_T$ = the section of the pipeline, in $cm^2$
$A_E$ = the section of the piston, in $cm^2$
$R_T$ = the inside radius of the pipeline, in cm
$R_{EGE}$ = the equivalent radius of the piston, in cm The above stated results show unequivocally that the process using a very low density polyurethane piston, introduced into the pipeline with a considerable reduction in diameter and following a course including several significant reductions in diameter of the pipeline, has a high efficiency in the removal of condensate liquids and water and can even be used as a measure for pipeline volume, without suffering significant losses in piston volume or without causing the destruction of the piston.

It is understood that the herein given examples and implementations do not constitute application limits for the present invention, once the herein mentioned device can safely be reckoned on for liquid material removal by means of a gas or fluid propelled piston, without the need of a high pressure difference.

Thus, the present invention is solely limited by the annexed claims.

I claim:

1. A method for removing liquids from the interior surfaces of a gas conducting pipeline comprising: introducing a piston into the pipeline in contact with said interior surfaces; passing said piston through said pipeline by means of a pressure differential on opposite sides of said piston; and pushing the liquids in said gas conducting pipeline through said pipeline by said piston, wherein said piston is formed as a cylindrical body consisting essentially of flexible, uncoated, spongy polymeric material having a density lower than 40 kg per cubic meter and a ratio of 1.5:1 to 2:1 between length and diameter of said piston so as to ensure a minimum liquid removal efficiency of 90% with minimum diameter loss of said piston as a result of passage through said pipeline.

2. A method according to claim 1, wherein said cylindrical body of said piston has a forward end shaped as a frustrum of a cone by slight beveling of a circumferential edge of said forward end.

3. A method according to claim 1, wherein said cylindrical body of said piston has a forward end shaped as a hemisphere or a paraboloid.

4. A method according to claim 1, wherein lateral surfaces of said piston are formed by cutting a prism with multiple rectangular surfaces of small width out of a block of spongy polymeric material to proximate a cylindrical shape.

5. A method according to claim 1, wherein the density of the spongy polymeric material is in a range between 17 and 33 kg per cubic meter.

* * * * *